US007212177B2

(12) United States Patent
Kanazawa et al.

(10) Patent No.: US 7,212,177 B2
(45) Date of Patent: May 1, 2007

(54) METHOD OF DRIVING A PLASMA DISPLAY APPARATUS

(75) Inventors: Yoshikazu Kanazawa, Kawasaki (JP); Shigeharu Asao, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 507 days.

(21) Appl. No.: 10/852,204

(22) Filed: May 25, 2004

(65) Prior Publication Data

US 2004/0212567 A1 Oct. 28, 2004

Related U.S. Application Data

(63) Continuation of application No. 10/080,410, filed on Feb. 25, 2002, now Pat. No. 6,809,708.

(30) Foreign Application Priority Data

Aug. 8, 2001 (JP) ..... 2001-240662

(51) Int. Cl.
*G09G 3/28* (2006.01)
*G09G 3/10* (2006.01)

(52) U.S. Cl. ..... 345/63; 345/67; 345/68; 345/690; 345/214; 315/169.1

(58) Field of Classification Search ..... 345/60–68, 345/690, 208–215; 315/169.1–169
See application file for complete search history.

(56) References Cited

U.S. PATENT DOCUMENTS 5,745,086 A 4/1998 Weber
5,877,734 A 3/1999 Amemiya
6,211,865 B1 * 4/2001 Hosoi et al. ..... 345/204
6,288,693 B1 9/2001 Song et al.
6,483,251 B2 11/2002 Setoguchi et al.
6,492,776 B2 12/2002 Rutherford
6,603,447 B1 8/2003 Ito et al.
6,836,261 B1 * 12/2004 Kishi et al. ..... 345/60

FOREIGN PATENT DOCUMENTS

EP 0 762 373 A2 3/1997
EP 0 965 975 A1 12/1999
EP 1 022 715 A2 7/2000
EP 1047042 A2 10/2000

(Continued)

*Primary Examiner*—Henry N. Tran
(74) *Attorney, Agent, or Firm*—Staas & Halsey LLP

(57) ABSTRACT

A method of driving a PDP apparatus to sufficiently suppress the background light emission and improve the dark room contrast, in which first electrodes and second electrodes are arranged adjacently by turns, a first display line is formed between one side of the second electrode and the first electrode adjacent thereto, a second display line is formed between the other side of the second electrode and the first electrode adjacent thereto, and the interlaced display that displays the first display line and the second display line alternately in different fields is performed, has been disclosed, wherein the reset voltage that directly relates to the intensity of the background light emission is varied according to the number of times of sustain discharges, the display conditions, and so on, in each subfield and the reset discharge is caused to occur with the minimum voltage in each subfield.

9 Claims, 10 Drawing Sheets

FOREIGN PATENT DOCUMENTS

| | | | |
|---|---|---|---|
| JP | 5-313598 | | 11/1993 |
| JP | 2801893 | | 7/1998 |
| JP | 11-272232 A | * | 10/1999 |
| JP | 2000-29431 | | 1/2000 |
| JP | 2000-501199 | | 2/2000 |
| JP | 2000-75835 | | 3/2000 |
| JP | 2000-172224 | | 6/2000 |
| JP | 2000-242224 | | 9/2000 |

* cited by examiner

METHOD OF DRIVING A PLASMA DISPLAY APPARATUS

CROSS-REFERENCE TO RELATED APPLICATIONS

This application is a continuation application of application Ser. No. 10/080,410, filed Feb. 25, 2002, and now U.S. Pat. No. 6,809,708.

This application is based upon and claims the priority of Japanese application no. 2001-240662, filed Aug. 8, 2001, and U.S. patent application Ser. No. 10/080,410, filed Feb. 25, 2002, the contents being incorporated herein by reference.

BACKGROUND OF THE INVENTION

The present invention relates to a plasma display (PDP) apparatus and a driving method thereof. More particularly, the present invention relates to a POP apparatus employing the ALIS (Alternate Lighting of Surfaces) method in which display lines are formed on both sides of each sustain discharge electrode and an interlaced display is attained, and a driving method thereof.

In Japanese Patent No. 2801893, a PDP apparatus employing the ALIS method, that can realize a display of high resolution at a low cost, has been disclosed. FIG.1 is a block diagram that shows the rough structure of the PDP apparatus employing the ALIS method disclosed in the document. As shown schematically, the PDP apparatus employing the ALIS method comprises a panel 1 in which first electrodes (X electrodes) X-1, X-2, . . . and second electrodes (Y electrodes) Y-1, Y-2, . . . , that constitute the sustain discharge electrodes, and address electrodes A-1, A-2, . . . , a control circuit 11, an address driver 13, a scan driver 12, an odd-numbered Y sustain discharge circuit 16, an even-numbered Y sustain discharge circuit 17, an odd-numbered sustain discharge circuit 14, an even-numbered X sustain discharge circuit 15, and a power supply circuit 18 are provided. Since it is disclosed in Japanese Patent No. 2001893, detailed description of the structure and operation of each element is omitted here.

The ALIS method is characterized by the interlaced display in which a first display line is formed between each Y electrode and the X electrode that is adjacent upward thereto, a second display line is formed between each Y electrode and the X electrode that is adjacent downward thereto, the first display line is displayed by odd-numbered fields, and the second display line is displayed by even-numbered fields and also characterized in that the number of display lines can be doubled with the same numbers of the X electrodes and the Y electrodes due to this characteristic and a much finer resolution can be attained.

For a PDP apparatus, various techniques have been proposed to improve the display quality and reliability, to reduce power consumption, to reduce in cost, and so on. The present invention relates to the reset operation and, as for this technique, for example, in Japanese Unexamined Patent Publication (Kokai) No. 2000-75835, the technique to improve the contrast by utilizing the reset pulse that has a voltage waveform of a gradual slope in the panel employing the ALIS method has been disclosed. Also in Japanese Unexamined Patent Publication (Kokai) No. 2000-501199, the reset method that utilizes a ramp wave has been disclosed. Furthermore, in Japanese Unexamined Patent Publication (Kokai) No.2000-242224, the technique, in which the reset pulse accompanied by lighting of all the display cells is applied only to the first subfield to improve the contrast, has been disclosed. Still furthermore, in Japanese Unexamined Patent Publication (Kokai) No.2000-29431, the technique, in which operations can be made stable by changing the reset voltage according to the ratio of light emission pixels in the subfield, has been disclosed, and in Japanese Unexamined Patent Publication (Kokai) No. 2000-172224, the technique, in which malfunctions can be suppressed by setting the voltage of the reset pulse according to the number of times of the sustain discharges in the immediately previous subfield, has been disclosed.

Recently, the display performance of the PDP apparatus has considerably improved and a performance almost the same as that of the CRT can be obtained with respect to luminance, resolution, contrast, and so on. As the broadcasting and the video software develop, however, further improvement is expected on the part of the display apparatus, and the dark room contrast is also required to improve further. The luminance of the black display, which causes the darkroom contrast to degrade, is the result of the light emission of the reset discharge needed to stabilize discharge, therefore, it has been necessary to cause a reset discharge to occur sufficiently in order to perform addressing of many display lines at a high speed, and the discharge has been needed to have a luminance of a certain level. As described above, stable operations and the dark room contrast are in the relationship of trade-off. According to the above-mentioned Japanese Unexamined Patent Publication (Kokai) No. 2000-242224, the background light emission (black luminance) is considerably reduced and the darkroom contrast improved by applying the reset pulse accompanied by lighting of all of the display cells once in one field, that is, only in one subfield, and by carrying out the erase discharge only in the display cells that were lit in the previous subfield, for the other subfields.

On the other hand, in the PDP apparatus employing the ALIS method disclosed in Japanese Patent No. 2801893, a dark room contrast of about 500:1 can be obtained by utilizing the reset pulse of the slope-shaped waveform disclosed in Japanese Unexamined Patent Publication (Kokai) No. 2000-75835. In this method, however, the reset discharge for all of the display cells is carried out in every subfield and, therefore, the luminance becomes about ten times as high as that of the background light emission when the technique disclosed in Japanese Unexamined Patent Publication (Kokai) No. 2000-242224 is applied. In a panel or a high-resolution panel that employs a method such as the ALIS method in which every gap between every pair of adjacent electrodes is used as a display line, the coupling between two adjacent display cells vertically apart is strong and it may easily happen that charges diffuse from a lit cell to an unlit cell. As a result, the condition of a display cell is altered even though the address discharge or the sustain discharge is not carried out after resetting. It has been necessary, therefore, to carry out the reset discharge for all of the display cells, including unlit cells, in order to be able to stably perform the address discharge in the next subfield.

FIG. 2A through FIG. 2D show the diffusion of charges to the adjacent display cells due to the sustain discharge in a panel employing the ALIS method. In the structure of the panel employing the ALIS method, sustain electrodes (X electrode, Y electrode) are equally spaced, and discharge is possible in any gap between all pairs of adjacent electrodes. In the figures, the action when a lit cell is formed between the X2 electrode and the Y2 electrode in an odd-numbered field is illustrated. FIG. 2A shows the sustain discharge period in the initial stage. The charged particles such as electrons or positive ions generated by discharge move within the discharge space by the force of electric field. In a panel or a high-resolution panel employing the ALIS method, the electrode of the adjacent cell exists in the vicinity of the lit cell and a strong force of electric field is applied thereto, therefore, charges are apt to move and accumulate thereon. In this case, the charges that diffuse to the adjacent cells are, in most cases, electrons that have a high mobility.

FIG. 2B shows the sustain discharge period in the latter stage of a subfield in which sustain discharge is repeatedly caused to occur, that is, the number of sustain discharge pulses is large (the sustain discharge period is long). When the process moves to the next subfield, if resetting (erasing) is performed only for lit cells as disclosed in Japanese Unexamined Patent Publication (Kokai) 2000-242224, charges in an unlit cell contiguous to a lit cell remain intact. In such a state, if the address period is entered and a scan pulse is applied to the Y1 electrode as shown in FIG. 2C, the voltage −170V of the scan pulse is overlapped by the voltage due to the negative charges accumulated on the Y1 electrode. Therefore, an address pulse is not applied to an unlit cell and a discharge is caused to occur between the X electrode and the Y electrode in a display cell without a discharge between the address electrode A and the Y electrode. This display cell is to emit light in the next sustain discharge period, resulting in an erroneous display. When negative charges are accumulated on the X3 electrode as shown in FIG. 2D, a scan pulse is applied to the Y3 electrode and, even if an address pulse is applied to the address electrode A to cause a discharge to occur between the Y3 electrode and the address electrode, no discharge is caused to occur between the X electrode and the Y electrode because the negative charges on the X electrode side lower the effective voltage, therefore, no sustain discharge is caused to occur because wall charges, necessary for the sustain discharge, are not formed. In other words, the cell is not lit.

As describe above, in such a panel employing the ALIS method, in which the electrodes of adjacent cells exist very closely, a reset discharge aimed at all the display cells of each subfield has been indispensable. Moreover, the reset voltage has been specified, a case in which the accumulated discharges are maximum being taken into account, and resetting has been performed with the voltage in all the subfields. Therefore, the reset voltage has been high and an improvement in the dark room contrast has not been sufficient because it is difficult to reduce the background light emission to below a certain level.

SUMMARY OF THE INVENTION

The present invention aims to solve these problems and the object is to realize a driving method of a PDP apparatus and a PDP apparatus that can sufficiently reduce the background light emission and further improve the dark room contrast even for a panel employing the ALIS method, in which the electrodes of adjacent cells exist closely.

In order to realize the above-mentioned object, in the present invention, the reset voltage that directly relates to the intensity of the background light emission can be altered according to the number of times of sustain discharges or the display state of each subfield. In this way, it is possible to improve the darkroom contrast by suppressing the background light emission, compared to a conventional way, because the reset discharge is caused to occur with the minimum voltage for each subfield. In concrete terms, the reset period first comprises a first erase period in which the wall charges of a display cell that was lit in the previous subfield are erased, secondly a write period in which a discharge is caused to occur for all the display cells to form the wall charges, and finally a second erase period in which all or part of the wall charges are erased again by a discharge, and the final voltage in the write period is adjusted.

BRIEF DESCRIPTION OF THE DRAWINGS

The features and advantages of the invention will be more clearly understood from the following description taken in conjunction with the accompanying drawings, in which.

DESCRIPTION OF THE PREFERRED EMBODIMENTS

Figure 1:
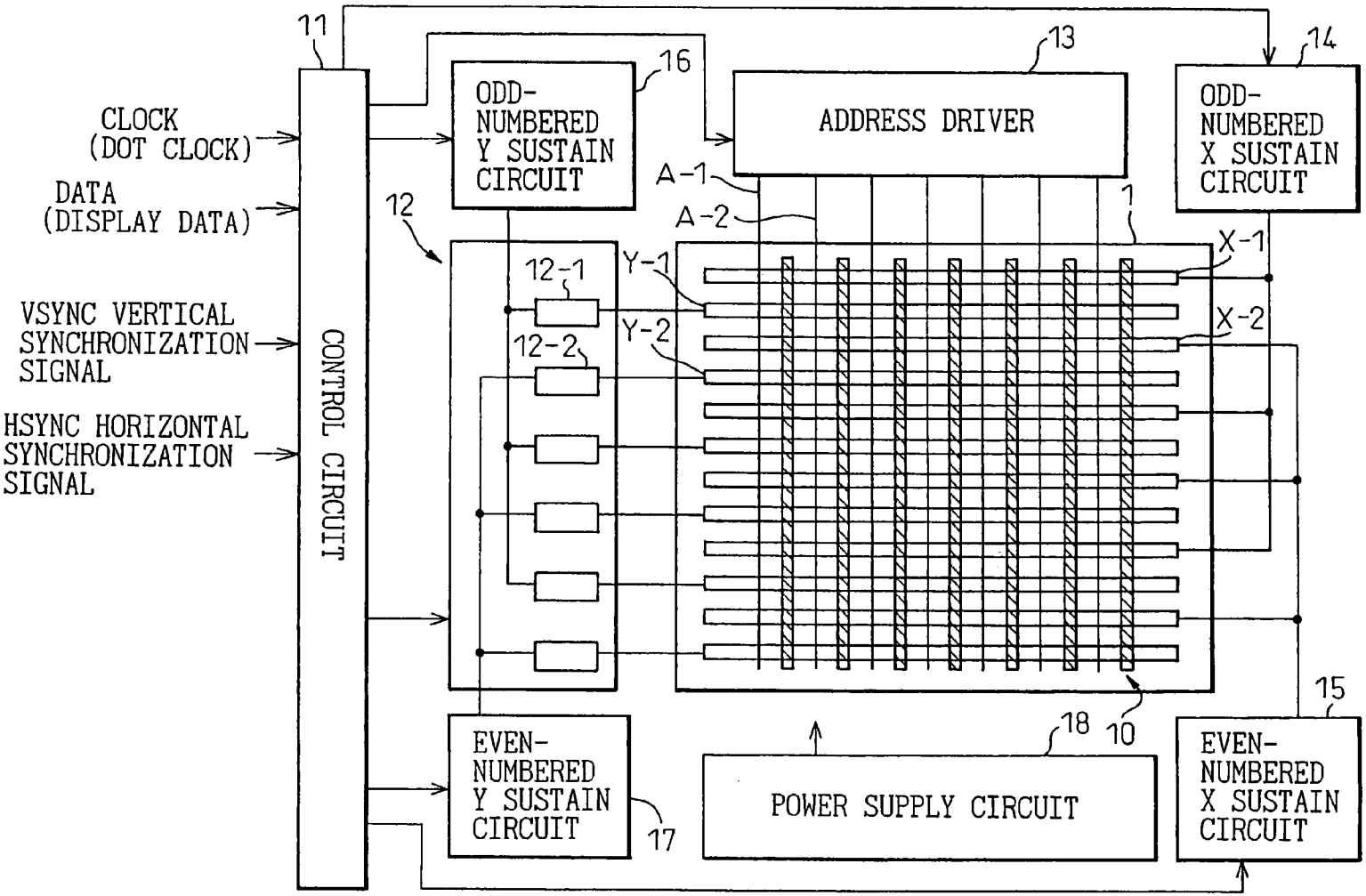
FIG. 1 is a block diagram that shows the rough structure of the plasma display apparatus (PDP apparatus) employing the ALIS method.

The embodiments of the present invention are described below, with example cases in which the present invention is applied to a PDP apparatus, employing the ALIS method disclosed in Japanese Patent No. 2001893, which has the structure as shown in FIG. 1.

Figure 3:
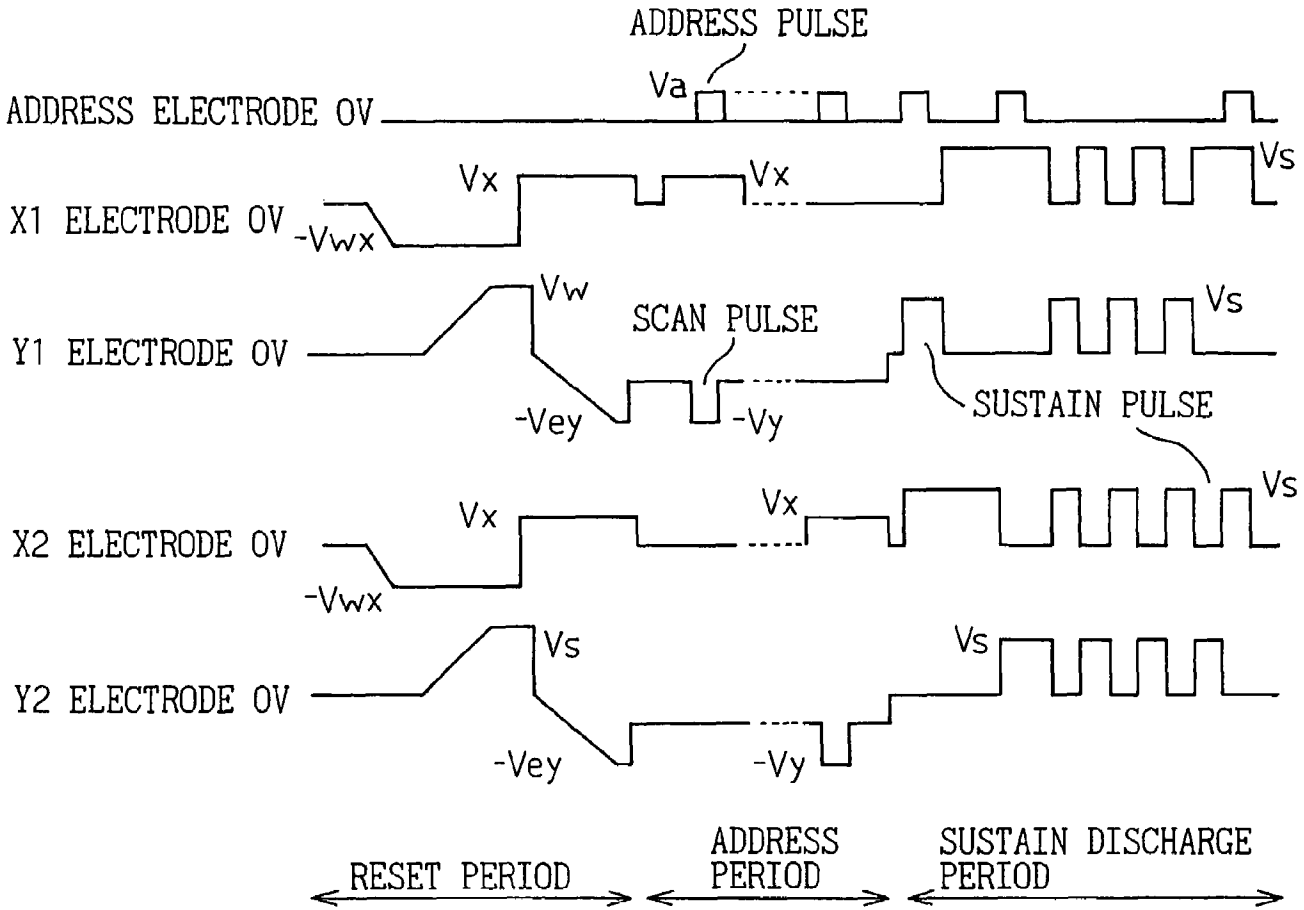
FIG. 3 is a diagram that shows the drive waveforms in the embodiments of the present invention.

FIG. 3 is a diagram that shows the drive waveforms in the odd-numbered field of the PDP apparatus in the embodiments of the present invention. The present invention is characterized by the drive waveforms in the reset period, while the address period and the sustain discharge period are the same as conventional ones, therefore, a description thereof is omitted here and the voltage waveforms in the reset period are described below.

Figure 4:
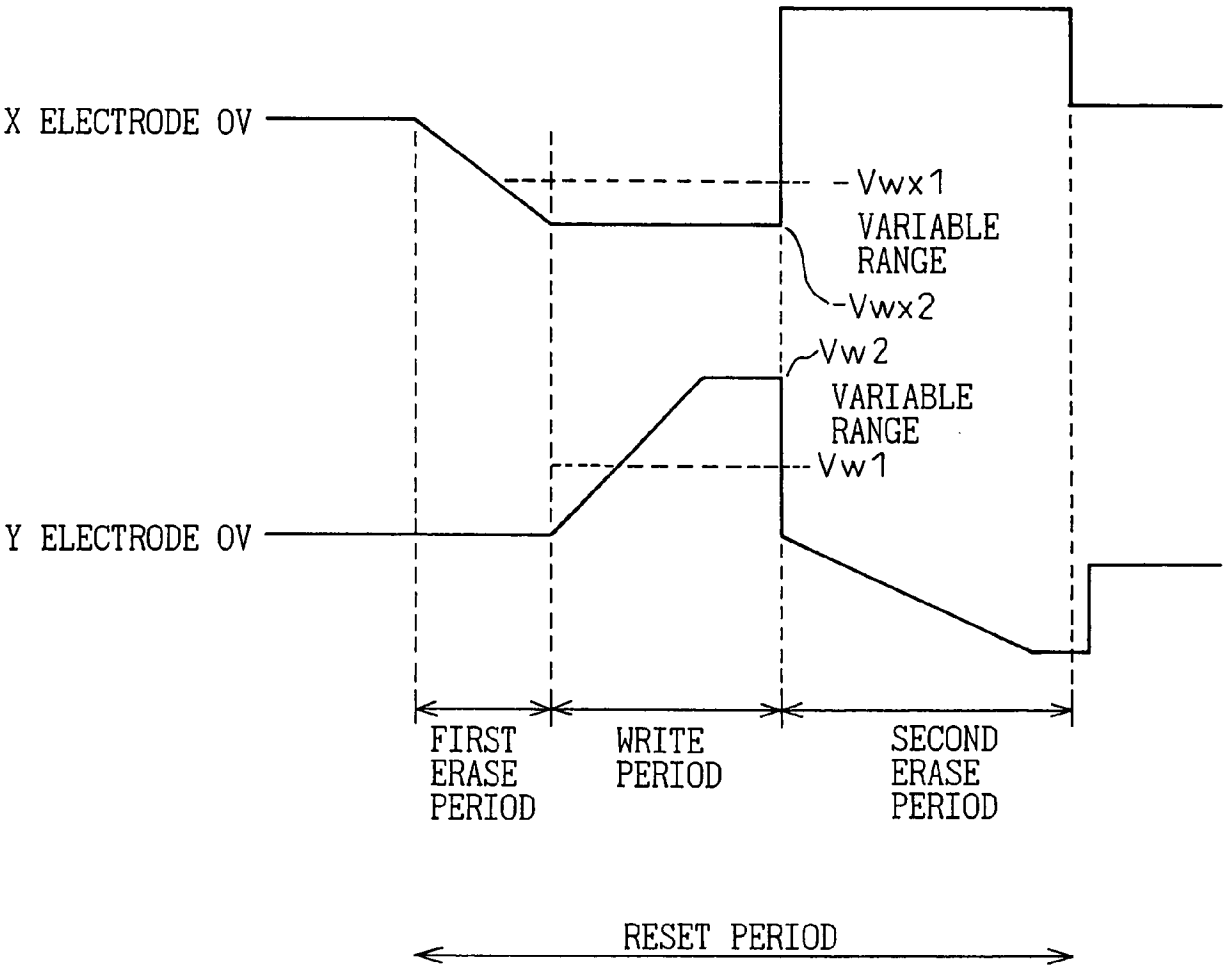
FIG. 4 is a diagram that shows the reset waveforms in the embodiments.

FIG. 4 is a diagram that shows the voltage waveforms to be applied to the X electrode and the Y electrode in the reset period in the embodiments of the present invention. In the reset period, a pulse of a gradual-slope-shaped waveform that gradually reaches −Vwx (−120V) is applied to the X electrode. The use of such a waveform erases the wall charges in the display cell that was lit in the previous subfield. This is the first erase period. Next, in the state in which the voltage of the X electrode is maintained, a pulse with a slope-shaped waveform is applied to the Y electrode and wall charges are formed by causing a discharge to occur in all of the display cells. This is the write period. Then, in the state in which the voltage Vx (90V) is being applied to the X electrode, a pulse of a slope-shaped waveform that reaches −Vey (−160V) is applied to the Y electrode. This is the second erase period.

The present invention is characterized in that a voltage, which is applied to the X electrode and the Y electrode in the first erase period and the write period, is adjusted. As shown in FIG. 4, the voltage to be applied has a slope-shaped waveform that gradually changes, therefore, adjusting the voltage means adjusting the voltage level to be applied finally. There are three methods of adjusting the voltage: a method of adjusting the voltage on the Y electrode side, a method of adjusting the voltage on the X electrode side, and a method of adjusting both. In FIG. 4, the final voltage, at which the slope-shaped waveform, to be applied to the X electrode, arrives varies between −Vwx1 and −Vwx2, and that at which the slope-shaped waveform, to be applied to the Y electrode, arrives varies between Vw1 and Vw2. The voltage −Vwx2 is −120V, which is the same as the conventional one, −Vwx1 is −50V, and the voltage in each subfield is set to a fixed value within this range. The voltage Vw2 is 200V, which is the same as the conventional one, Vw1 is 100V, and a fixed value is set within this range according to the condition of the subfield and the display state.

Figure 5:
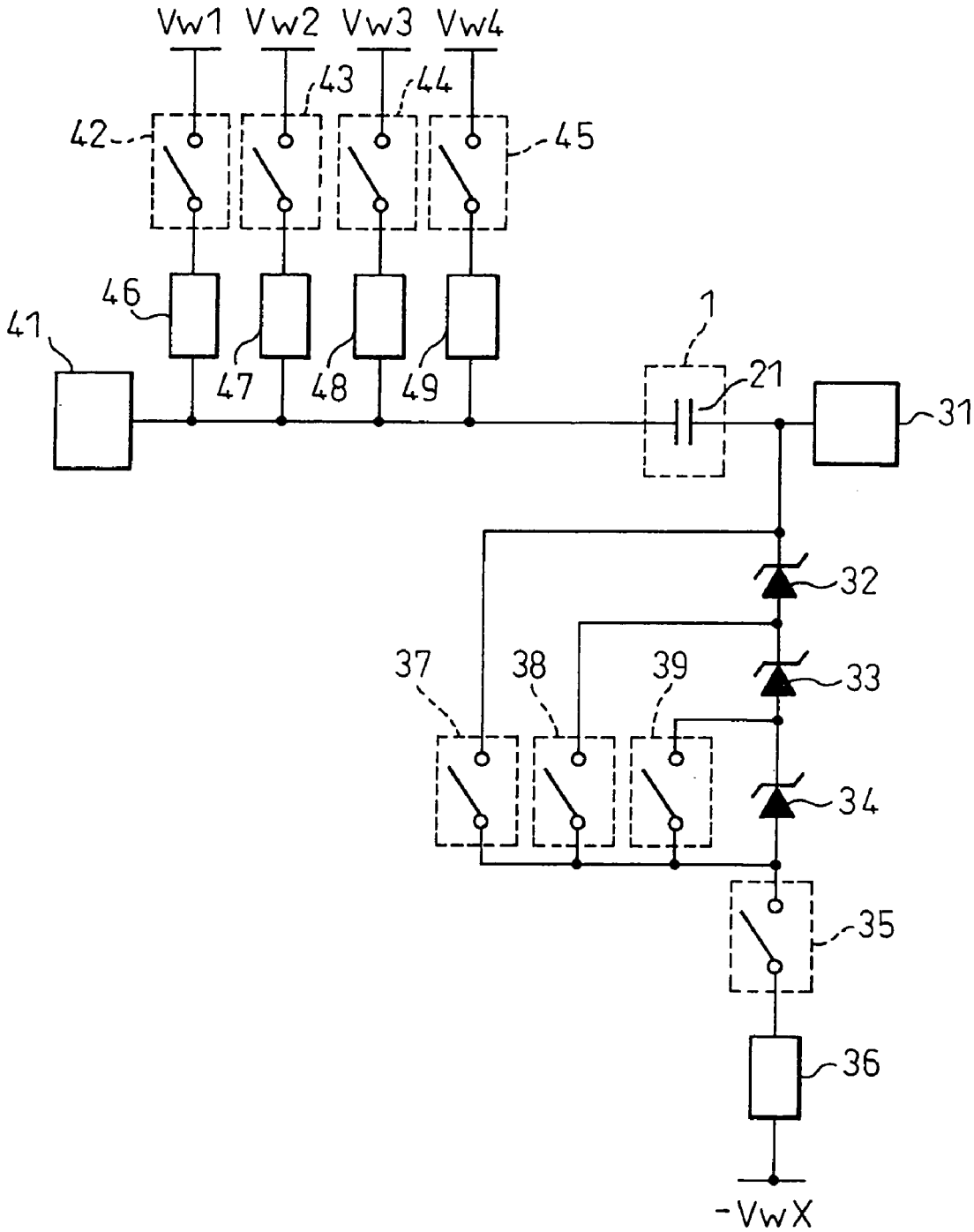
FIG. 5 is a diagram that shows the structure of the sustain electrode drive circuit in the embodiments.

FIG. 5 is a diagram that shows the structure of the drive circuit that produces the reset waveforms as mentioned above, and the structure corresponds to the parts of the odd-numbered X sustain circuit 14, the even-numbered X sustain circuit 15, the odd-numbered Y sustain circuit 16, and the even-numbered Y sustain circuit 17 in FIG. 1. Reference number 31 refers to a circuit that generates a sustain discharge pulse to be applied to the X electrode, and reference number 41 refers to a circuit that generates a sustain discharge pulse to be applied to the Y electrode. In this drive circuit, four kinds of voltage values for resetting are prepared in advance for the X electrode side and the Y electrode side, respectively. The voltage to be applied to the Y electrode of a display cell 21 in the panel 1 is selected by selectively turning on one of switches 42 to 45 corresponding to the voltage value. The power supply of the lowest (the absolute value is the greatest) voltage −Vwx is provided for the X electrode side and a switch 35 is turned on while a switch 37 is maintained on to select the voltage. To select a voltage greater (the absolute value is less) than that, a switch 38 or a switch 39 is turned on while the switch 37 is maintained off, or the switch 35 is turned on while both the switches 38 and 39 are maintained off. When the switch 37 is turned on, the voltage −Vwx is sent to the X electrode of the display cell 21 in the panel 1, and otherwise a voltage, which is obtained by subtracting the voltage determined by one to three Zener diodes from the voltage −Vwx, is sent. In the present embodiment, the Y electrode side generates the output voltage from plural power supplies and the X electrode side generates the output voltage from a single power supply utilizing Zener diodes, but it is possible to employ either one method for both the X electrode side and the Y electrode side at the same time. In the present embodiment, there are only four kinds of voltage values for the output voltage, but this is enough to suppress the background light emission sufficiently.

Figure 6:
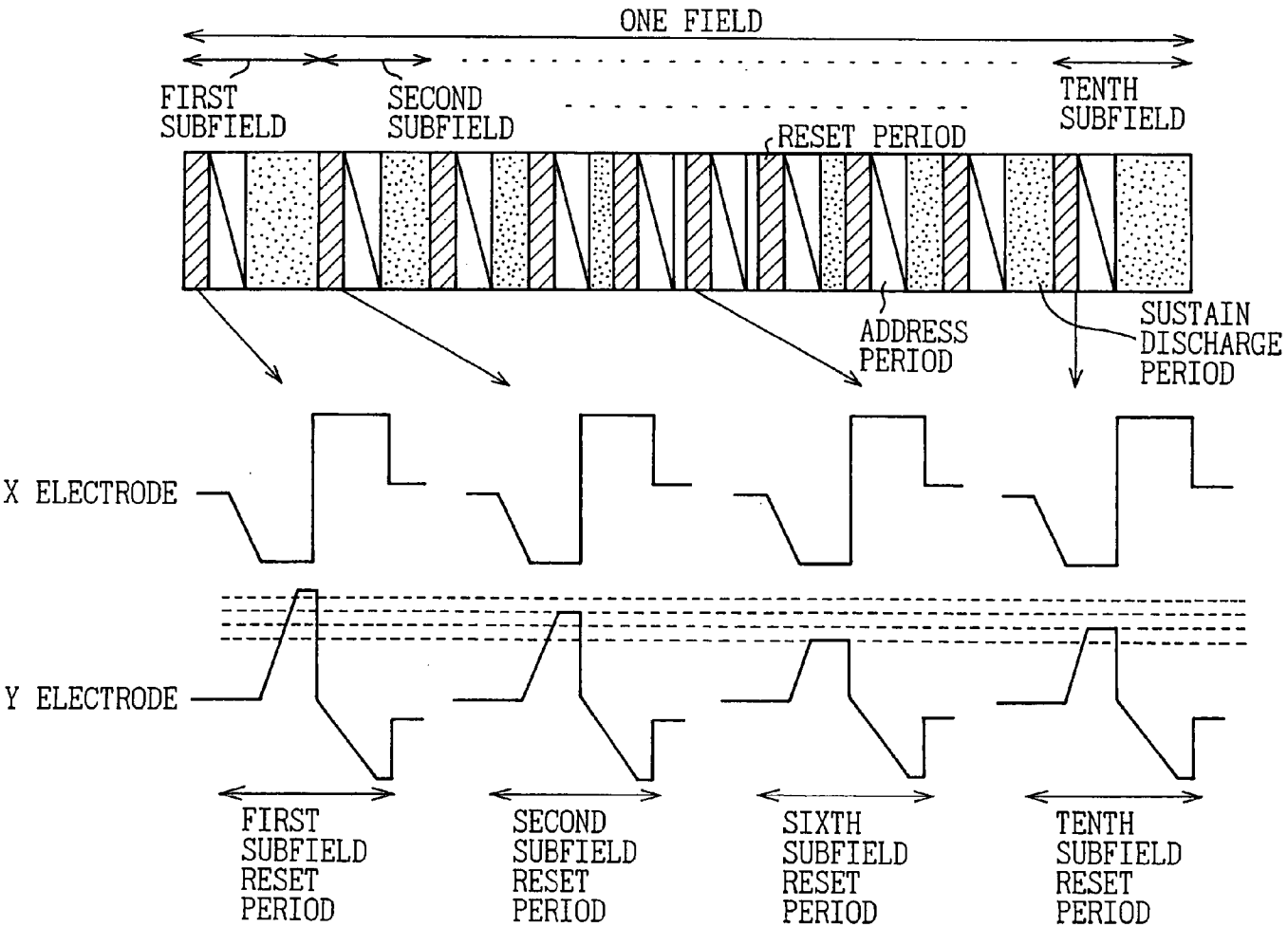
FIG. 6 is a diagram that shows the reset waveforms in each subfield in the first embodiment of the present invention.

FIG. 6 is a diagram that shows the reset waveforms in each subfield in the first embodiment of the present invention. Since the PDP apparatus can only light to emit or not, the display of gray level is attained by composing each field by plural subfields and combining the subfields to be lit. In the first embodiment, one field (odd-numbered field or even-numbered field) is composed of 10 subfields and the sustain discharge periods of the first subfield and the tenth subfield are the longest and brightest because the number of the sustain discharge pulses is the greatest. The nearer the center, the shorter the sustain discharge period of the subfield is. This is the display sequence to suppress the color false contour that is an image quality degradation phenomenon inherent to the PDP apparatus.

Figure 2A:
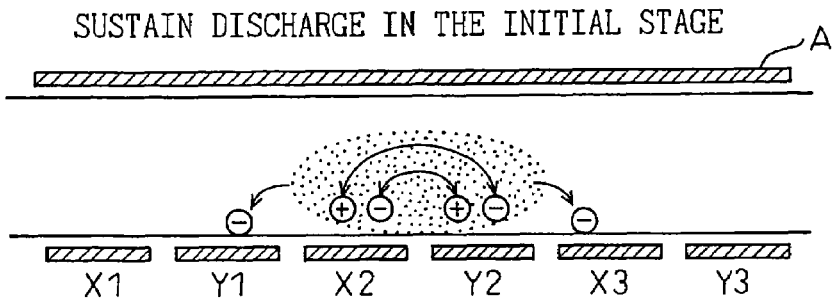
FIG. 2A through FIG. 2D are diagrams that illustrate the problems relating to the conventional techniques.
Figure 2B:
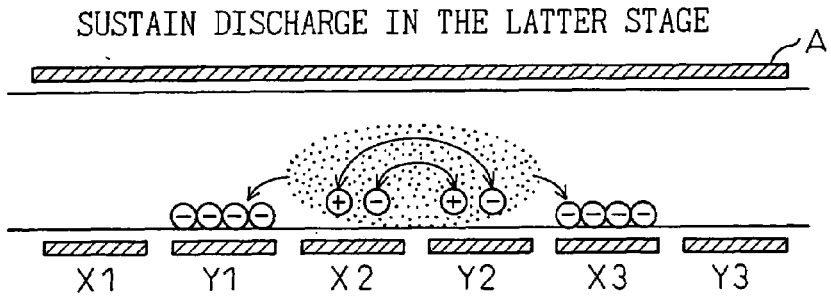
Figure 2C:
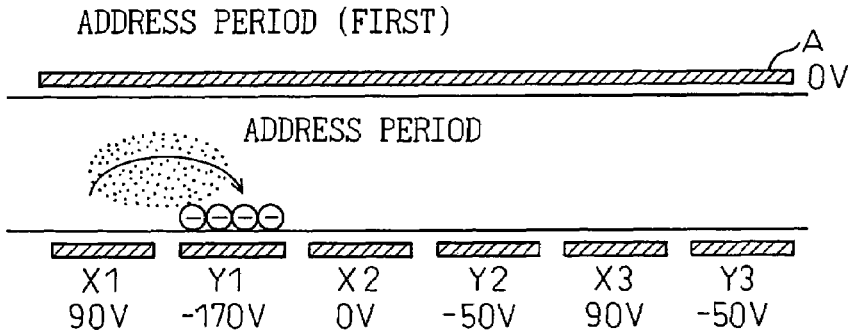
Figure 2D:
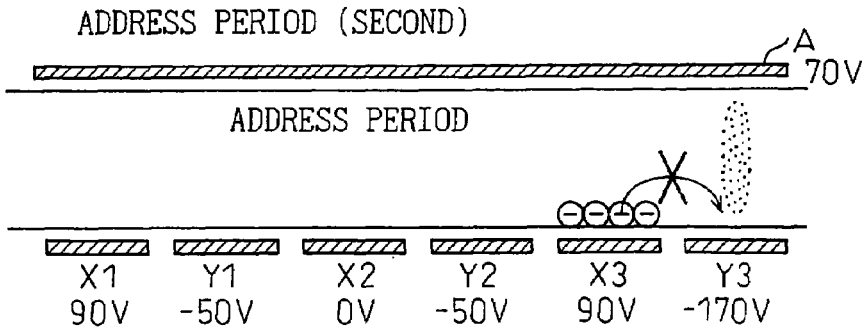

In the first embodiment, only the voltage Vw, which is applied to the Y electrode in the write period of the reset period, is made variable and this voltage is referred to as the reset voltage. In the first embodiment, the reset voltage in the first subfield is made greatest for the reasons described below. The first reason is that it is necessary to maintain active the side of a pair of electrodes that were not lit in the previous field, because the display of odd-numbered rows and that of even-numbered rows are switched in the first subfield in the ALIS method. The second reason is that since the period of each field is synchronized with the vertical synchronization signal entered from the outside of the display apparatus, it is necessary to generate space charges by causing a comparably strong discharge to occur in advance in all of the display cells when the video signal has a long period of the vertical synchronization signal, because the interval between the completion of the final subfield and the inception of the first subfield is lengthened and the priming effect that affects the stability of discharge is degraded. The third reason is that since the number of times of the sustain discharge in the tenth subfield is large, it may happen that many electrons have accumulated in the adjacent cells as shown in FIG. 2(B), therefore a high voltage is required, for example, because the electrons accumulated on the Y electrode side lower the effective value of the reset voltage (Vw). For the reasons described above, it is necessary to set the reset voltage in the first subfield to about 200 V. Conventionally, the voltage of 200 V was an excessive applied voltage in the subfields other than the first subfield because the voltage was applied to all the subfields.

The reset voltage in the second subfield can be lowered to below that of the first subfield because the first and the second reasons described above no longer exist, although the number of times of the sustain discharges in the immediately previous first subfield is large.

The number of times of the sustain discharges in the fifth subfield is the least, and is only a few times, and there are few charges accumulated in the adjacent display cells as described in FIG. 2, therefore, the state established in the previous reset period is maintained even in an unlit cell contiguous to a lit cell. Therefore, the reset voltage of the subsequent sixth subfield is set to the least voltage, and to about 100 V. Since the discharge threshold voltage between the X electrode and the Y electrode is about 220 V, a discharge is seldom caused to occur in an unlit cell.

The reset voltages of the third subfield through the fifth subfield are between the reset voltage of the second subfield and that of the sixth subfield, and the reset voltages of the seventh subfield through the tenth subfield are set to those which are slightly greater than that of the sixth subfield because the length of the sustain discharge period gradually increases. The length of the reset period is fixed in the first embodiment.

Figure 7:
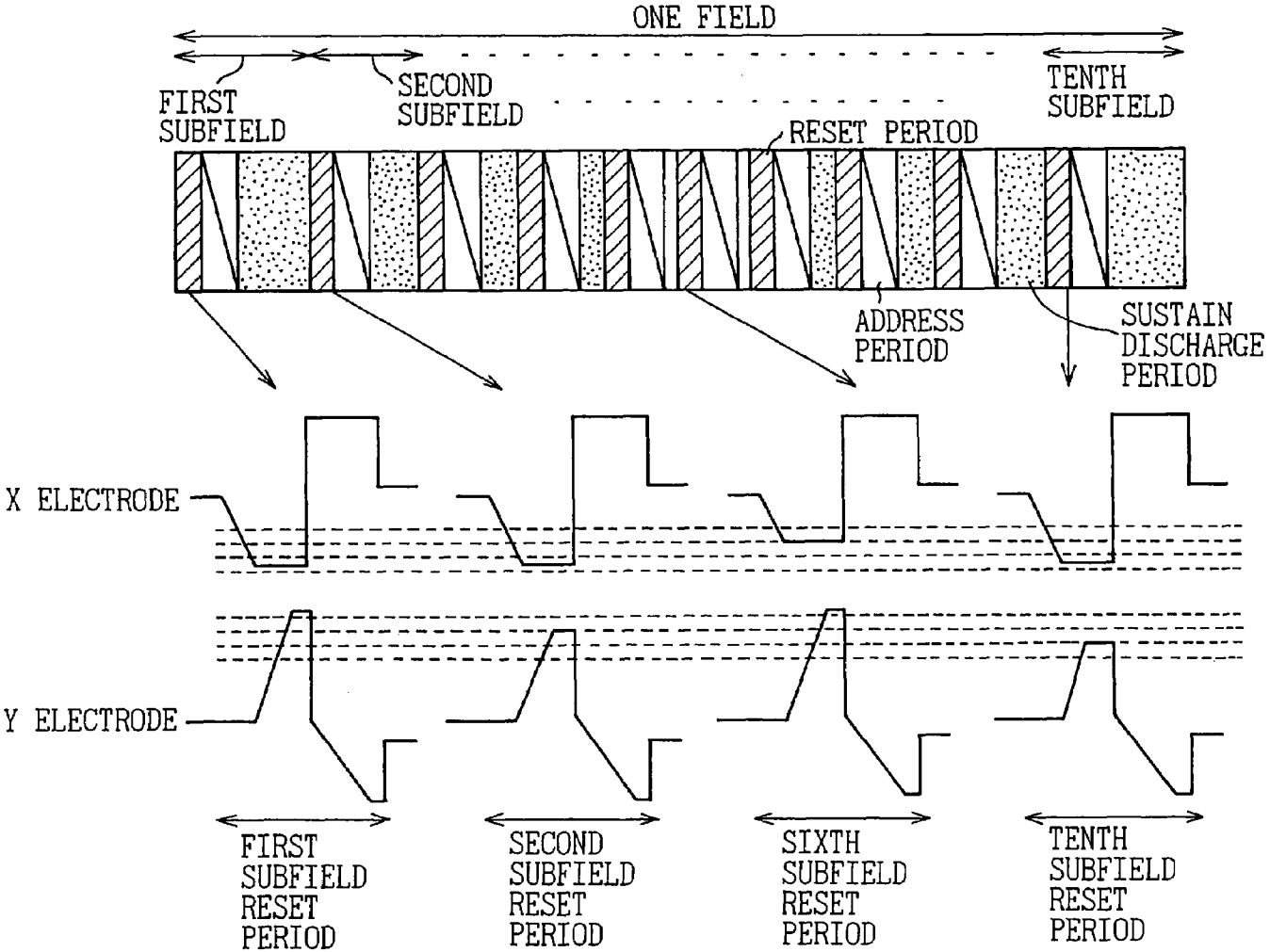
FIG. 7 is a diagram that shows the reset waveforms in each subfield in the second embodiment of the present invention.

FIG. 7 is a diagram that shows the reset waveforms in each subfield in the second embodiment of the present invention. The differences from the first embodiment shown in FIG. 6 are that not only the voltage Vw to be applied to the Y electrode is varied but also the voltage to be applied to the electrode is varied according to various conditions. The absolute values of the voltage to be applied to the X electrode in the first erase period and that to be applied to the Y electrode in the write period of the reset period in the first subfield are made large for the same reasons as those described above. Although the reset voltage in the first subfield is made low in the first embodiment, the absolute value of the voltage on the X electrode side is made less (actually greater because it is a negative voltage) in the second embodiment, while the voltage to be applied to the Y electrode is maintained high. The reason is described below. On the average, the address electrode becomes a cathode in the sustain discharge period therefore the negative charges formed by the address discharge on the address electrode side are exposed to the sustain discharge and gradually erased. If, however, the number of times of the sustain discharges is small, they are hard to erase. It is not preferable for the charges to remain because they would act to lower the effective value of the address pulse voltage. Therefore, in order to erase the negative charges on the address electrode side in the reset period, the voltage between the Y electrode and the address electrode is set so as to be large even though that between the X electrode and the Y electrode is set so as to be low and erasing the negative charges on the address electrode side is promoted by the discharge between the address electrode and the Y electrode.

Figure 8:
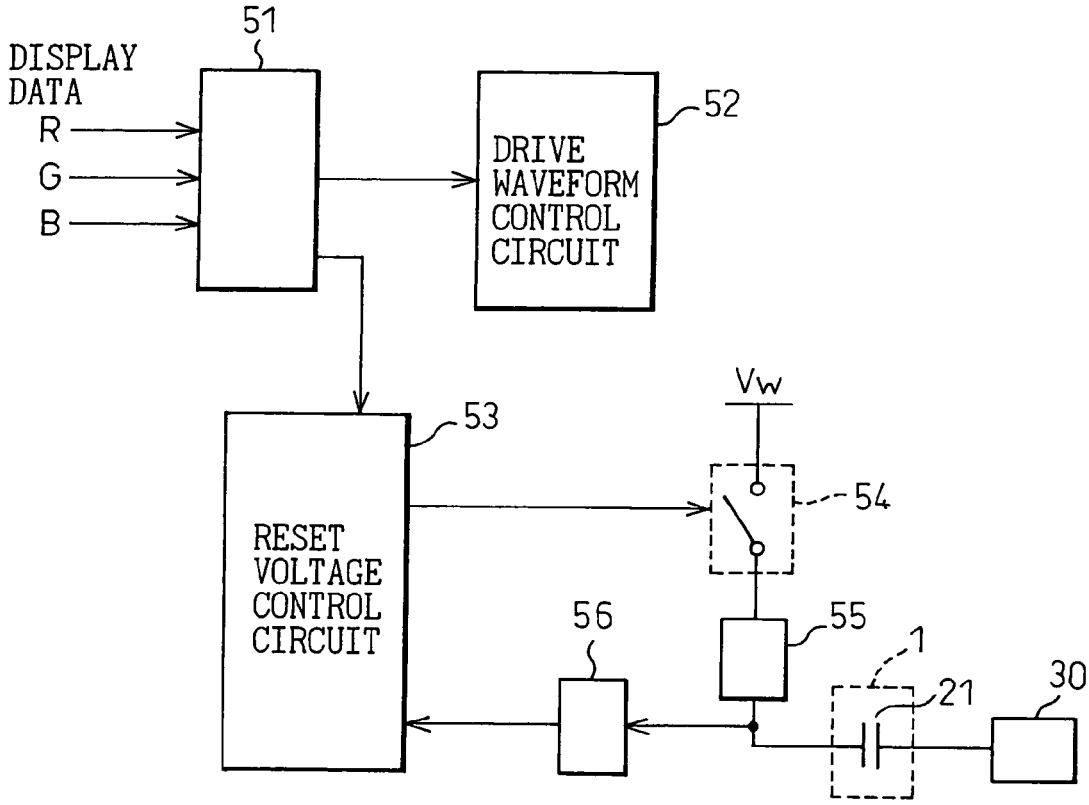
FIG. 8 is a diagram that shows the structure of the sustain electrode drive circuit in the third embodiment of the present invention.

FIG. 8 is a diagram that shows the structure of the sustain electrode drive circuit in the third embodiment of the present invention. In the drive circuit in the first and the second embodiments shown in FIG. 5, the output voltages are generated by providing plural power supplies of different voltages or utilizing the Zener diodes with the single power supply, but the drive circuit in the third embodiment differs in that the voltage to be applied to the electrode is gradually varied and the application of voltage is terminated when a fixed value is reached by monitoring the voltage of the electrode. It is assumed that an X electrode side drive circuit 30 has the same structure as that of the X electrode side drive circuit shown in FIG. 8. The reset voltage Vw is applied to the Y electrode of a display cell 21 via a current limiter 55 by turning a switch 54 on. Because the current limiter 55 is provided, the current that enters the panel 1 is limited and the voltage of the Y electrode varies with a gradual-slope-shaped waveform. Moreover, the reset pulse voltage to be applied to the Y electrode is monitored by a voltage detector 56 and the switch 54 is turned off by a reset voltage control circuit 53 when a fixed voltage is reached. The reset voltage control circuit 53 receives information such as of a subfield in operation and about the number of times of the sustain discharges from a display sequence control circuit 51 and determines the reset voltage to be applied based on this information.

Figure 9:
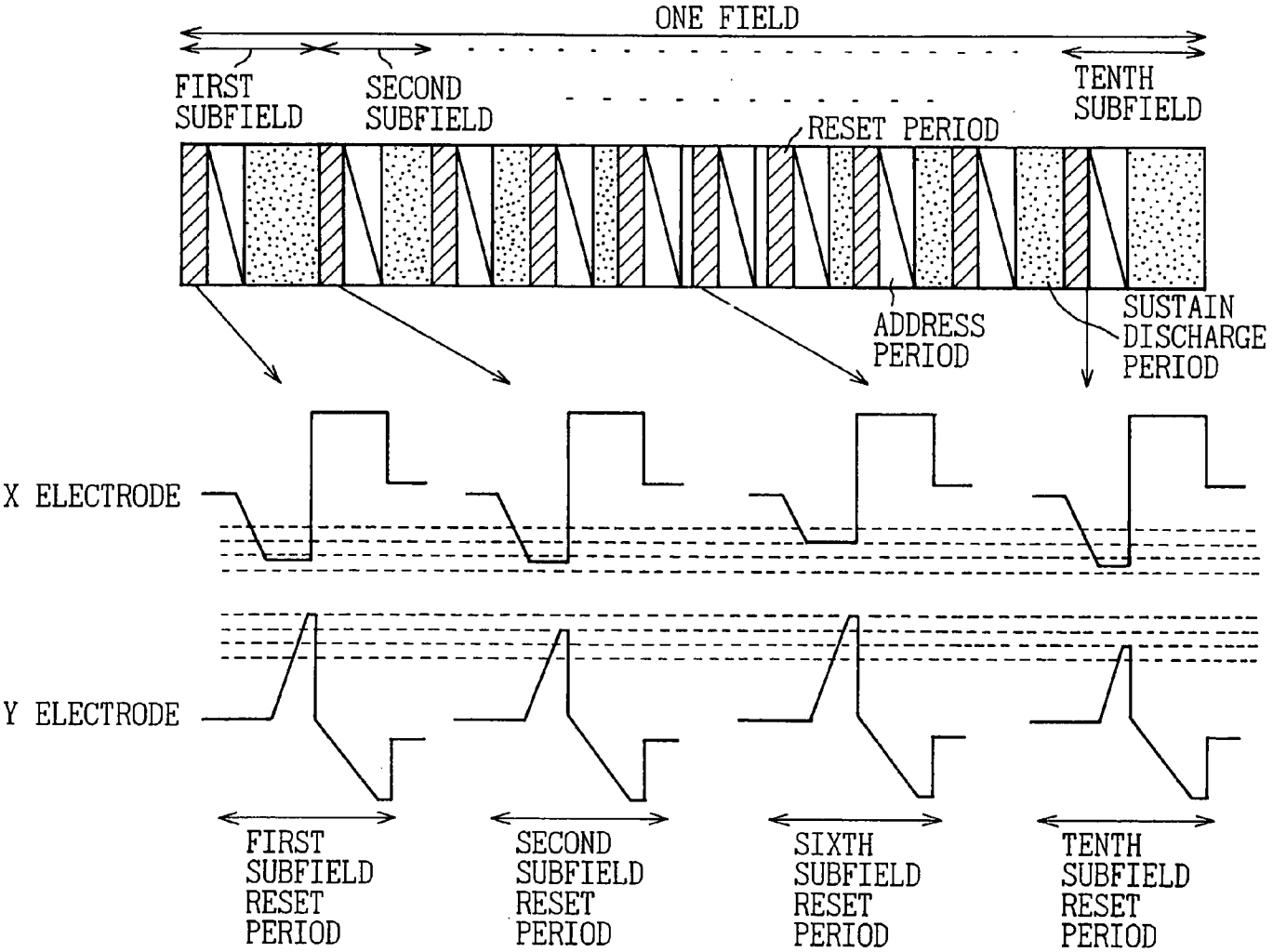
FIG. 9 is a diagram that shows the reset waveforms in each subfield in the third embodiment.

In the third embodiment, at the same time as the switch 54 is turned off when the reset voltage reaches a fixed value, the next erase process is initiated. FIG. 9 is a diagram that shows the reset waveforms in each subfield in the third embodiment. Although the voltages of the Y electrodes are maintained for a while after reaching each fixed value as shown in FIG. 6 and FIG. 7, respectively, the application of voltage is terminated immediately after the voltages of the Y electrode reach each fixed voltage, respectively, in the third embodiment and the action of the next erase period is initiated. This will reduce the operating time and the saved time can be used, for example, to lengthen the sustain discharge period.

The first through third embodiments are described above, and it is needless to say that the optimum values are set for each voltage and output voltage according to the panel design or drive conditions.

Figure 10:
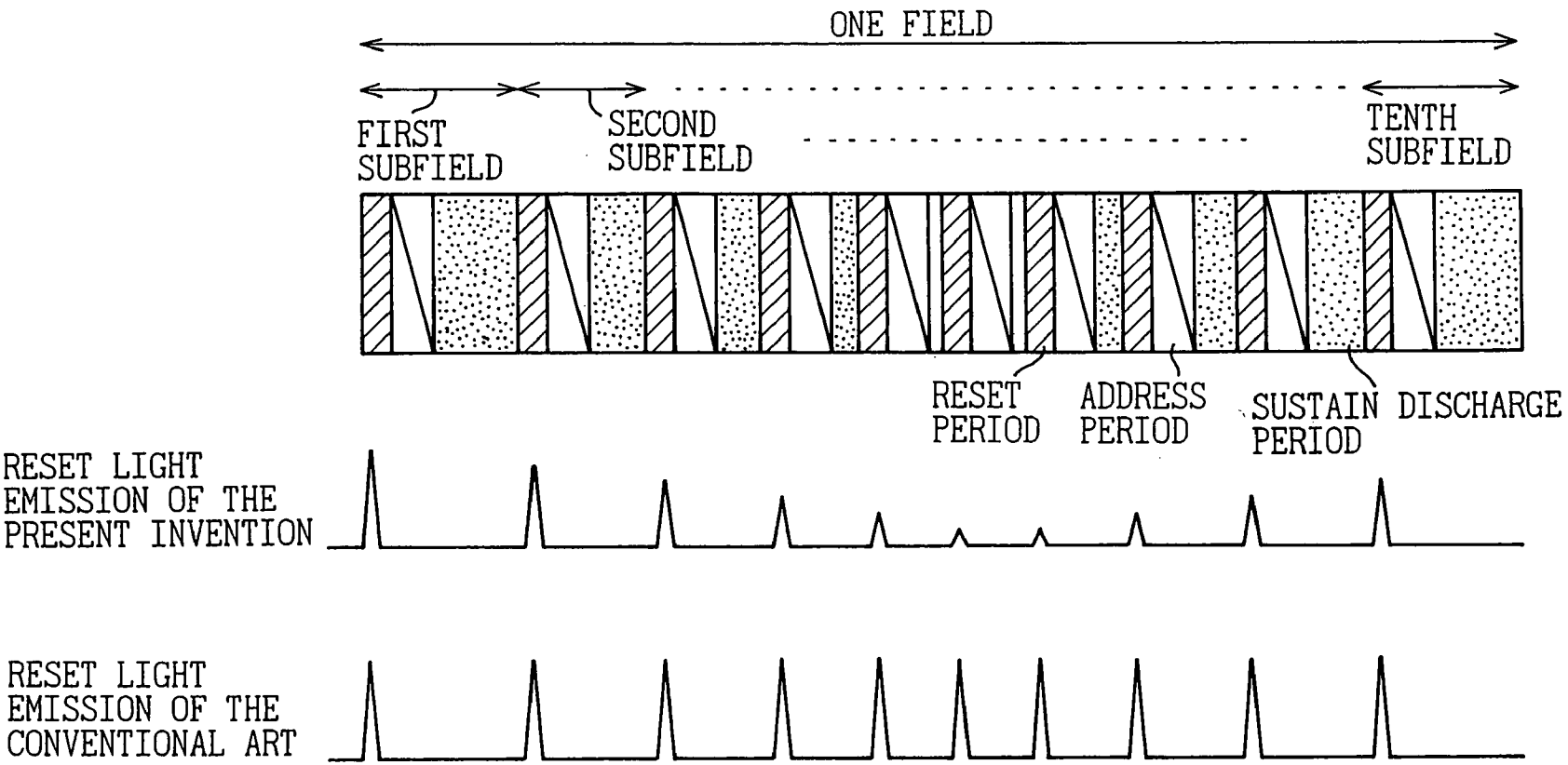
FIG. 10 is a diagram that shows the effects of the present invention.

FIG. 10 is a diagram that illustrates the effects of the present invention, comparing the intensity of the reset light emission, when the reset voltage in each subfield is controlled so as to be optimum as shown in the first through the third embodiments, to that of the conventional art. As shown schematically, the light emission intensity by the reset pulse is made less in the center, the background luminance is lowered to about half to one third of the conventional one, and the darkroom contrast is doubled or tripled.

As described above, the main reason is that the charges generated by the discharge diffuse and accumulate on the electrodes of the adjacent display cells when the number of times of the sustain discharges is large. Therefore, when the number of times of the sustain discharges is small in the previous field, it is possible to lower the reset voltage in the next field. For example, a power increase is limited by shortening the length of the sustain discharge period when the display ratio is high in the PDP apparatus and, in such a case, it is possible to lower the reset voltage in the write discharge process.

As described above, according to the present invention, the background luminance can be suppressed and the dark room contrast can be improved because it is not necessary to apply an excessively great voltage for the reset discharge in each subfield.

What is claimed is:

1. A method of driving a plasma display apparatus having first electrodes and second electrodes extending in a first direction and arranged adjacently by turns, wherein each display field comprises subfields, and each subfield comprises at least one of a reset period, an address period, and a sustain discharge period, and the subfields in each display field include subfields for a write discharge process that performs an entire write discharge, the method comprising:

in the write discharge process for the entire discharge process, applying respective different voltage levels during the corresponding, different subfields of a given field.

2. The method of driving a plasma display apparatus as set forth in claim 1, wherein the reset period comprises the write discharge process and an erase discharge process, in the subfields that perform the entire write discharge, and the write discharge process is a slope-shaped waveform having the voltage level gradually changing in a positive direction and the erase discharge process is a slope-shaped waveform having the voltage level gradually changing in a negative direction.

3. A method of driving a plasma display apparatus having first electrodes and second electrodes extending in a first direction and arranged adjacently by turns and third electrodes extending in a direction perpendicular to the first direction, wherein each display field comprises subfields, and each subfield comprises a reset period, an address period, and a sustain discharge period, comprising:

in the reset period, executing a write discharge process and an erase discharge process, wherein a voltage waveform in the write discharge process is a slope-shaped waveform, a voltage of which gradually changes, and in the write discharge process, at least one subfield comprising a voltage different from the other subfields.

4. A method of driving a plasma display apparatus, as set forth in claim 3, wherein, in the write discharge process, the voltage to be applied to the first electrode or that to be applied to the second electrode, or that to be applied to both is varied and a fixed voltage is applied to the third electrode.

5. A method of driving a plasma display apparatus, as set forth in claim 3, wherein a period of the write discharge process is constant and the voltage is maintained until a completion of the write discharge process, after a reference voltage is reached in each subfield.

6. A method of driving a plasma display apparatus, as set forth in claim 3, wherein a rate of change of the voltage of the voltage waveform in the write discharge process is the same in each of the subfields and erase discharge process is performed immediately after the voltage in the write discharge process reaches a reference voltage.

7. A plasma display apparatus having first electrodes and second electrodes extending in a first direction and arranged adjacently by turns, third electrodes extending in a direction perpendicular to the first direction, wherein each display field comprises subfields, and each subfield comprises a reset period, an address period, and a sustain discharge period, the plasma display apparatus comprising:

a drive circuit applying a drive voltage to the first and the second electrodes, and, in the write discharge process, outputting a voltage, for at least one subfield, different from voltages of the other subfields, wherein in the reset period, a write discharge process and an erase discharge process are executed, and a voltage waveform in the write discharge process is a slope-shaped waveform, a voltage of which gradually changes.

8. A plasma display apparatus, as set forth in claim 7, wherein the drive circuit comprises:

plural power supplies for the write discharge process and the voltage during the write discharge process is determined by a selection of a power supply from the plural power supplies.

9. A plasma display apparatus, as set forth in claim 7, wherein the drive circuit comprises:

a voltage source circuit in which the voltage gradually increases to a reference value as time elapses, and a voltage monitor circuit that monitors the voltage to be applied to the first and second electrodes, and the application of the voltage is interrupted when the voltage to the first and second electrodes reaches the reference value.

* * * * *